United States Patent [19]

Sanders

[11] 4,389,024

[45] Jun. 21, 1983

[54] METHOD AND APPARATUS FOR PACKAGING STRANDS

[75] Inventor: James E. Sanders, Newark, Ohio

[73] Assignee: Owens-Corning Fiberglas Corporation, Toledo, Ohio

[21] Appl. No.: 319,942

[22] Filed: Nov. 10, 1981

[51] Int. Cl.[3] ..... B65H 54/02; B65H 57/04; B65H 57/16

[52] U.S. Cl. ..... 242/18 G; 65/10.2; 242/42; 242/157 R

[58] Field of Search ..... 242/18 G, 42, 157 R, 242/157 C, 35.5 R; 226/196; 65/10.2, 11 R; 28/198, 199; 57/352, 354, 357, 358

[56] References Cited

U.S. PATENT DOCUMENTS

| | | | |
|---|---|---|---|
| 3,254,978 | 6/1966 | Hayes | 242/42 X |
| 3,371,877 | 3/1968 | Klink et al. | 242/18 G |
| 3,414,956 | 12/1968 | Genson | 242/18 G X |
| 3,506,420 | 4/1970 | Jackson, Jr. et al. | 242/18 G X |
| 3,821,543 | 6/1974 | Gelin et al. | 242/42 |

FOREIGN PATENT DOCUMENTS

| | | | |
|---|---|---|---|
| 994763 | 6/1965 | United Kingdom | 242/18 G |
| 1386954 | 3/1975 | United Kingdom | 242/18 G |

*Primary Examiner*—Stanley N. Gilreath
*Attorney, Agent, or Firm*—Ronald C. Hudgens; Philip R. Cloutier; Greg Dziegielewski

[57] ABSTRACT

Method and apparatus for attenuating and collecting glass filaments are provided comprising a rotatable collet adapted to wind said strands thereon; a traversing means adapted to move the strands along the length of said collet, said traversing means having an axis of movement; guide means located adjacent said traversing means, said guide means having a plurality of spaced apart strand accommodating notches wherein at least two of the notches are contained in a reference plane that is obliquely oriented with respect to the axis of movement of said traversing means or axis of rotation said collet to facilitate the maintenance of the individuality of each of the strands being wound into said package.

17 Claims, 11 Drawing Figures

METHOD AND APPARATUS FOR PACKAGING STRANDS

TECHNICAL FIELD

The invention disclosed herein relates to the production and collection of continuous glass filaments wherein a plurality of glass filaments are separated into a plurality of bundles or strands that are wound simultaneously into a single package.

BACKGROUND OF INVENTION

In the production of continuous filament glass strands, it is sometimes desirable to supply, simultaneously, more than one strand to a given package. In some instances, a plurality of filaments are drawn from a single fiber forming feeder and two groups of four strands each are wound into two separate packages. That is, each package receives a group of four separate bundles of filaments.

To provide such separate bundles, the filaments are "split" into separate strands or bundles through the use of guide "shoes".

As shown in U.S. Pat. No. 3,821,543, issued to Gelin et al. on June 28, 1974, first and second guide shoes are employed to split the filaments into four distinct bundles to be wound in close proximity to one another in a single package.

As is known in the art, the glass filaments are coated with a sizing or binder to reduce interfilament abrasion. Unfortunately, since the individual strands are wound in close proximity to one another and the size, generally, has not been dried or cured, two or more of the individual strands may tend to adhere to one another to form a larger, but undesirable, strand. That is, instead of acting as, for example, four independent strands, the group will act as three or fewer independent strands of substantially unequal number of filaments therein.

The present invention described herein, has been shown to reduce the tendency of the "splits" to adhere to one another and to reduce the tendency for such strands to form undesirable "loops" at the package, and thus providing a more desirable packaging of multi-strand packages.

DISCLOSURE OF THE INVENTION

The invention disclosed herein pertains to a guide means or member located immediately above the strand traversing device associated with the winder wherein said guide means has a plurality of notches adapted to accommodate a bundle of filaments therein, and wherein at least two of said notches are contained within a plane obliquely oriented with respect to the axis of rotation of the traversing means or the collet of the winder.

DETAILED DESCRIPTION OF THE INVENTION

Figure 1:
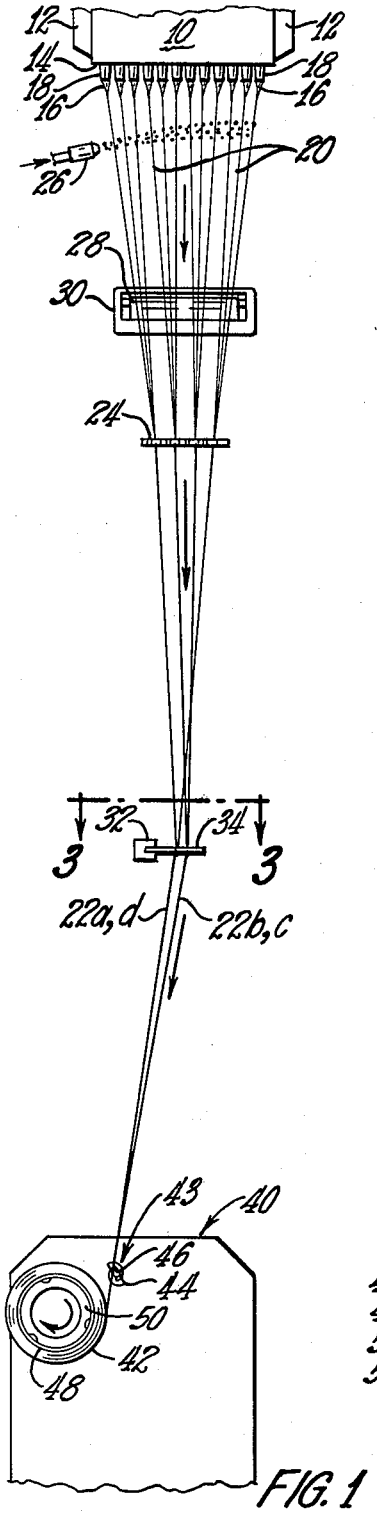
FIG. 1 is a front elevational view of apparatus according to the principles of this invention simultaneously collecting a plurality of glass strands into a single wound package in a continuous glass filament forming operation.
Figure 2:
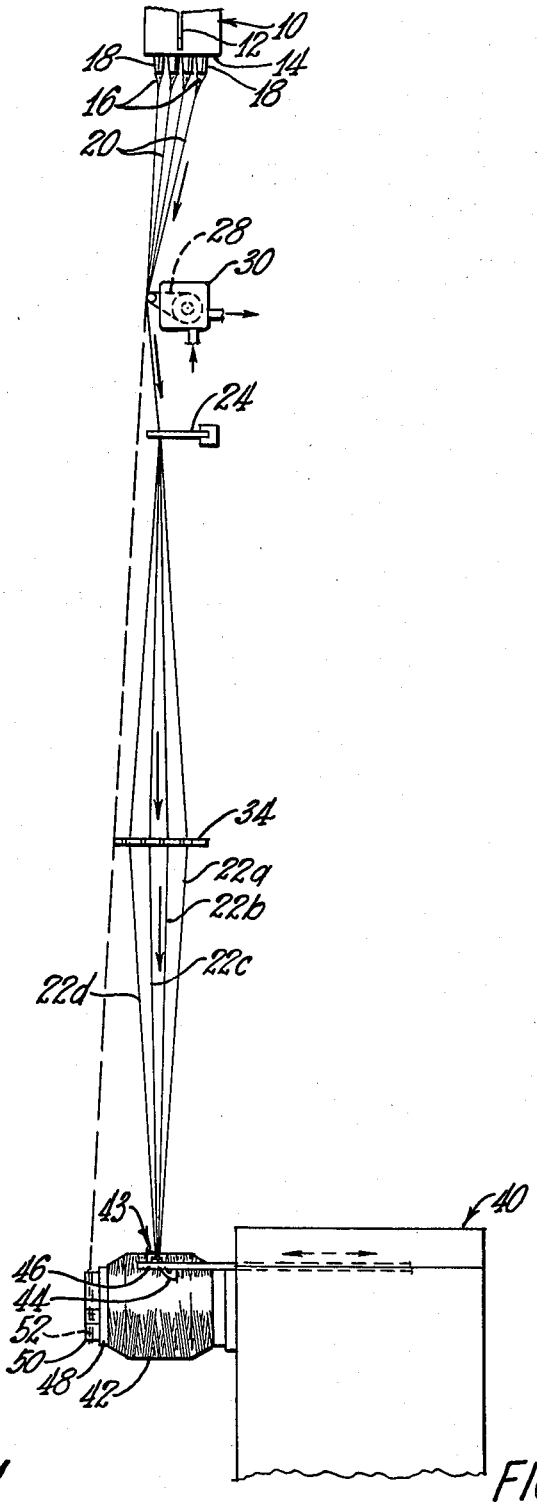
FIG. 2 is a side elevational view of the apparatus shown in FIG. 1.

As shown in FIGS. 1 and 2, fiber forming feeder 10 is adapted to supply a plurality of streams of molten inorganic material, such as glass, to be attenuated into continuous filaments 20 through the action of winder 40.

Feeder 10 also includes a pair of terminals 12 adapted to be connected to a suitable supply of electrical power (not shown). Bottom wall 14 of feeder 10 may be substantially planar having a plurality of orifices therethrough, or may be equipped with a plurality of projections 18 having at least one orifice in each. As shown in FIGS. 1 and 2, streams 16 depend from projections 18.

Feeder 10 may be comprised of any suitable material, such as platinum or a platinum alloy.

Intermediate feeder 10 and winder 40, a number of pieces of apparatus are employed, generally, in the production of continuous glass filaments.

Nozzle 26 is adapted to spray a mist or fog of water upon newly formed filaments 20 prior to the contacting of applicator means 28 by filaments 20.

Generally, applicator means 28 is supported within housing 30, and applicator means is adapted to supply a sizing or other liquid coating material to filaments 20.

Downstream of applicator means 28, shoe element 24 or guide element 24 is adapted to gather filaments 20 into a plurality of strands or bundles of filaments 22*a, b, c,* and *d*. As can be seen in FIG. 1, the filaments 20 contact applicator means as a plurality of spaced-apart arrays of spaced-apart filaments.

Preferably, guide element 24 is of the type described in the aforementioned U.S. Pat. No. 3,821,543 which is hereby incorporated by reference.

From the first shoe or guide element 24, strands 22 are advanced downwardly to engage a second guide means or member 34 as shown, the guide means 34 turns the plane of strand travel approximately 90 degrees from the planar orientation effected by shoe 24. However, the orientation of the strands 22 at second guide means 34 is substantially different from that disclosed in the aforementioned patent. The orientation of the strands at guide member 34, which will be disclosed in more detail later herein, provides a system wherein a plurality of individual strands can be collected into a single package in close proximity to one another wherein the strands have a reduced tendency to adhere to one another. Also, the present invention provides a system wherein the strands have an improved tendency to remain substantially parallel throughout the complete package winding cycle. That is, the catenary of the strands or splits is also improved.

With the old systems, there was an occasional tendency of an individual strand to assume a path substantially different from the remaining strands for at least a small portion of the winding cycle wherein a loop or catenary would be formed in the package by one or more of the strands. In short, the present invention increases the tendency of the strands to remain independent of one another, and yet provide for depositing the strands in the package in a substantially parallel orientation throughout the package build cycle.

As is known in the art, it is desired to deposit the plurality of strands 22 in generally parallel close proximity to one another as a helically wound band of filamentary material. Strands 22 are wound into package 42 through the action of winder 40, and winder 40 is comprised of traversing means 43 and rotatable collector means or collet 50. Traversing means 43 is comprised of a rotatable shaft 46 which is adapted to be reciprocated along its axis of rotation 47 to deposit the strands as a helix on collet 50. Spiral wires 44 which are attached to rotatable shaft 46 are adapted to agitate strands 22 along axis 47 to facilitate the winding of the strands into package 42. For example, see U.S. Pat. Nos. 2,391,870 and 3,276,945.

Generally, package 42 is wound around tube 48 which has been telescoped or slid over collet 50. Collet 50 has an axis of rotation 51.

Figure 3:
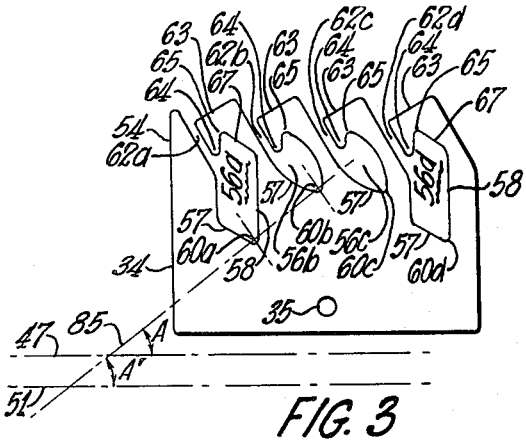
FIG. 3 is a plan view of a portion of the apparatus shown in FIG. 1 taken along View 3—3.

As shown in FIG. 3, guide means or member 34 is comprised of a plate or body of any suitable material, having a plurality of openings 56 *a, b, c* and *d* in communication with a plurality of circular notches 60 *a, b, c* and *d*. Shoe element 24 and guide means 34 are preferably made from material that does not abrade glass filaments, such as Micarta.

Preferably, circular notches 60 *a, b, c* and *d* are associated with opposing surface portions 57 and 58 as set forth in U.S. Pat. No. 3,821,543; that is, the angles formed at the intersection of the circular notch 60 and opposing surface portions 57 and 58 should form an angle greater than 180 degrees and substantially less than 270 degrees, with an angle of about 240 degrees being preferred. Also, the corners are rounded or radiused to reduce strand abrasion.

The notches 60 may be of any suitable shape, but notches having a rounded or circular geometry are preferred. Further, the radius of circular notches should be only slightly larger than the desired radius for the strand bundle associated therewith. Guide surfaces 63 serve to facilitate the gathering of the filaments 20 into distinct and separate bundles or strands 22 and to facilitate the movement of the strands 22 into the passageways 62 *a, b, c* and *d* which are in communication with openings 56 *a, b, c* and *d*, respectively. Preferably, each of the strands or splits has an unsubstantially equal number of filaments therein.

As shown in the drawings, strands 22 *a, b, c,* and *d* ride in or pass through notches 60 *a, b, c* and *d*, respectively, during the package build cycle.

During start-up, or other periods, it may be necessary for the operator to interrupt the package build cycle and move the strands to temporary collection region 52 of collet 50. At such times, the strands 22 can exhibit a tendency to leave the notch 60 associated therewith. Therefore, guide means 34 should include a lip or hook section 64, which partially defines passageway 62, having a recess section 65 associated therewith to retain the strand generally within the appropriate opening 56. Generally, recess 65 is located on the side opening 56 opposite from notch 60.

Second guide means 34 should be oriented, among other things, such that the strands 22 move along edge 67 between notch 60 and recess 65 when the strands are being moved to or from temporary collection region 52. Further, guide means 34 is adapted to be securely mounted to bracket 32, such as by means of screw 33 in conjunction with hole 35 located in body 54.

As shown in FIG. 3, a straight line 85 passing through a common point in notches 60*a* and 60*b* forms an angle "A" with axis of rotation 47 of traversing means 43 and/or an angle "A" with axis of rotation 51 of collet 50. Since such elements are at different elevations, the lines determined thereby do not actually intersect, but when viewed from above, that is in plan, the angles formed from such projections are readily determined. Alternatively, common points of notches 60*a* and 60*b* are contained within a reference plan 85 that is obliquely oriented with respect to the axis of rotation 47 and/or axis of rotation 51. Reference plane 85 is substantially vertical, as shown. That is, according to the principles of this invention, guide means 34 having a plurality of notches 60 therein has at least two notches that are contained in a reference line or a reference plane that is obliquely oriented with respect to the axis of rotation of the traversing means and/or the axis of rotation of the collet. If the axis of rotation 47 is parallel to the axis of rotation 51, angles A and A′ should be equal.

As shown in the drawings, the points in common of notches 60*a* and 60*b* are shown as the center line for such circular notches. However, other points in common, such as the apexes of such notches, and the like, are suitable for determining the orientation of the notches with respect to the axes of rotation.

As shown in FIG. 3, the outer most two notches 60*a* and 60*d*, when viewed in plan, are substantially closer to the axes of rotation 47 and 51 than the central two notches 60*b* and 60*c*.

Figure 11:
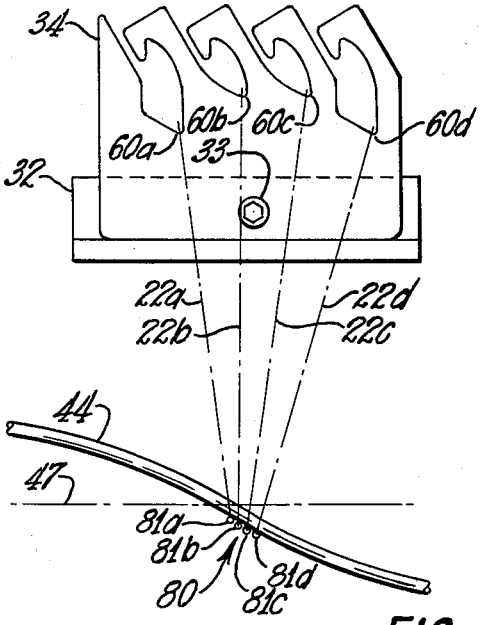
FIG. 11 is another sectional plan view of a portion of the fiber forming operation shown in FIG. 1.

As can be determined from FIGS. 1, 3 and 11, strands 22 *a, b, c* and *d* define or form a conically shaped region or zone extending from notches 60 *a, b, c* and *d* to contact points 81 *a, b, c* and *d* of contact region 80 along spiral wire 44 of traversing means 43.

Figure 9:
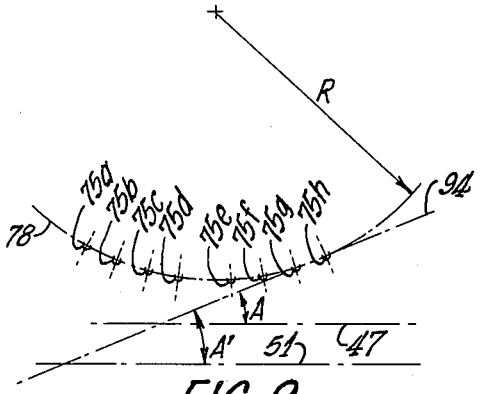
FIG. 9 is a schematic plan view of the notches of another guide means.

When incorporating some of the other designs for orienting the notches in guide member 34, such as shown in FIG. 9, the conically shaped region can have an arcuate configuration.

During operation, contact region 80 moves along the length of spiral wires 44 as the spiral wires are rotated, and in conjunction with the reciprocal movement of shaft 46 along the axis of rotation 47 by traversing means 43 the strands 22 *a, b, c* and *d* are helically wound into package 42 as a tape-like band of individual, but substantially parallel strands.

The obliquely oriented reference lines or reference planes should form an angle within the range from about 5 degrees to about 65 degrees, with the range from about 10 degrees to about 55 degrees being preferred.

Figure 4:
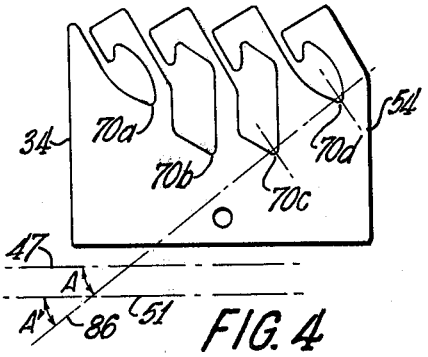
FIG. 4 is a plan view of another guide means.

As shown in FIG. 4, guide means 34 is adapted to accommodate four strands or splits in notches 70 *a, b, c* and *d*, and notches 70*c* and 70*d* determine a reference line 86 or fall within a reference plane 86 oriented substantially oblique or transverse with respect to axes of rotation 47 and/or 51. Notches 70*b* and 70*c* are positioned substantially closer to axes 47 and/or 51 than the outermost two notches 70*a* and 70*d*.

In spite of the fact that the inner most two notches 60*b* and *c* and 70*b* and *c* determine a line or plane that is substantially parallel to the axes of rotation 47 or 51 such guide members have been shown to improve the catenary and splitting efficiency of the fiber forming and collecting systems described herein.

Figure 5:
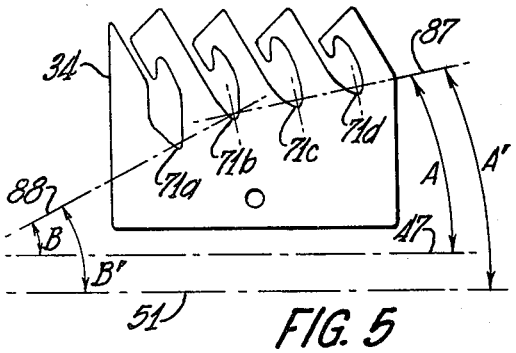
FIG. 5 is a plan view of another guide means.

As shown in FIG. 5, guide means or member 34 incorporates four notches 71 *a, b, c* and *d*. Notches 71 *b, c* and *d* determine a reference line 87 or fall within a reference plane 87 which is perpendicular to the plane containing notch 71*a, b, c* and *d* of member 34 and which is obliquely oriented with respect to axes of rotation 47 and/or 51 forming an angle A or A', respectively.

However, notches 71*a* and 71*b* determine a reference line or are contained within a reference plane 88 which is obliquely oriented with respect to axes 47 and/or 51 which form angles B and B' therewith, respectively. It is to be noted that each pair of notches may form an obliquely oriented reference line or reference plane at an angle different than all the other reference lines or planes formed by other mutually adjacent notches.

As set forth herein such "reference planes" containing the specified notches are vertically oriented and/or perpendicular to the plane defined by plate 54 and/or perpendicular to the plane containing all such notches of member 34.

Figure 6:
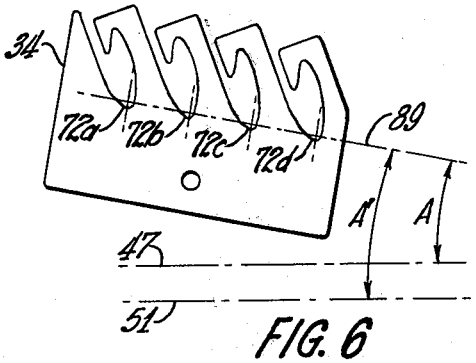
FIG. 6 is a plan view of another guide means orientation.

As shown in FIG. 6, a second guide member or means 34, produced substantially according to the aforementioned U.S. Pat. No. 3,821,543 is mounted in conjunction with bracket 32 such that notches 72 *a, b, c* and *d* form a reference line 89 or are contained within a reference plane 89 that is obliquely oriented with respect to axes 47 and/or 51 to form angles A and A', respectively. Thus, substantially "misaligning" second guide member 34 with respect to the teachings of the aforementioned patent, can produce an improved split strand collection system.

Figure 7:
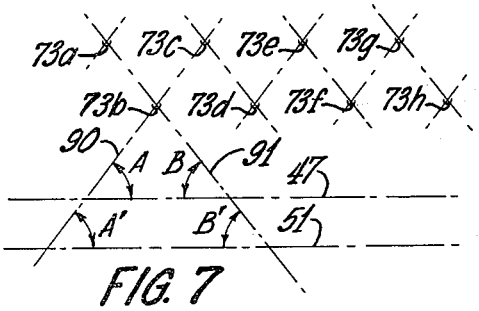
FIG. 7 is a schematic plan view of the notches of another guide means.

As shown in FIG. 7, notches 73 *a, c, e* and *g* determine a line or are contained within a common planar section spaced from and substantially parallel to axes 47 and 51. Notches 73 *b, d, f* and *h* determine a line or are contained within a common second planar section substantially parallel to the first common planar section and axes 47 and 51. However, the second common planar section containing notches 73 *b, d, f* and *h* is spaced from the first planar section and is positioned closer to axes 47 and 51 as shown in FIG. 7.

With notch 73*b* being located between notches 73*a* and *c*; notch 73*d* being located between notches 73*c* and 73*e*; and notch 73*f* being located between notches 73*e* and 73*g* a "sawtooth" type of configuration is provided. That is, alternate notches are contained within a common reference plane or define a reference line oriented substantially oblique with respect to axes 47 and 51. For example, notches 73*a* and 73*b* determine a reference line 91 or common reference plane 91 which intersects axes 47 and/or 51 at angles B and B', respectively. Also, notches 73*c* and 73*b* determine a reference line or are contained within reference plane 90 that is oriented substantially oblique or transfersely oriented with respect to axes 47 and 51 such that angles A and A', respectively, are formed. As such, a band of 8 splits or individual strands can be accommodated. However, it is to be understood that any suitable number of splits and notches may be employed, as desired.

Figure 8:
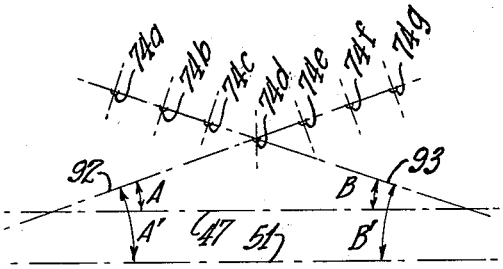
FIG. 8 is a schematic plan view of the notches of another guide means.

As shown in FIG. 8, seven notches, 74*a, b, c, d, e, f,* and *g* are located along intersecting lines or planes 92 and 93. Reference line or plane 92 intersects axes 47 and 51 forming angles A and A', respectively. Likewise, reference line or plane 93 intersects axes 47 and 51 thereby forming angles B or B', respectively. As shown in FIG. 8, the apex of the "V groove" formed by the notches 74 is pointed toward axes 47 and 51, but it is to be noted that the notches can be oriented to provide the apex of the "V" pointing away from the axes 47 and 51.

As shown in FIG. 9, notches 75 *a, b, c, d, e, f, g* and *h* are located along arcuate line 78 having a radius R. For example, notches 75*g* and 75*h* determine a reference plane or line 94 that is obliquely oriented with respect to axes 47 and 51 such that angles A and A' are formed therefrom, respectively. It is to be understood that arcuate line 78 may either be convex with respect to axes 47 and 51, as shown in FIG. 9, or may be concave.

Figure 10:
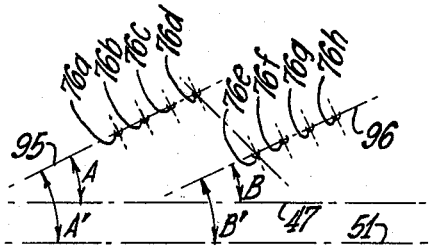
FIG. 10 is a schematic plan view of the notches of another guide means.

As shown in FIG. 10, a "Z" type array of notches 76 *a, b, c, d, e, f, g* and *h* is provided. Notches 76 *a, b, c,* and *d* determine a reference line 95 or are contained within a reference plane 95 that is obliquely oriented with respect to axes 47 and/or 51 such that angles A and A' are formed, respectively. Further, notches 76 *e, f, g* and *h* determine a line or are contained within a reference plane 96 that is obliquely oriented with respect to axes 47 and/or 51 such that angles B and B' are formed, respectively. It is to be understood that angles A and B may be equal or may be different from one another. Similarly, angles A' and B' may be so arranged.

It is apparent that within the scope of the invention, modifications and different arrangements can be made other than as herein disclosed. The present disclosure is merely illustrative with the invention comprehending all variations thereof.

INDUSTRIAL APPLICABILITY

The invention described herein is readily applicable to the formation of packages of glass filaments.

I claim:

1. Apparatus for collecting a plurality of strands into a single package comprising:
   - a rotatable collet adapted to wind said strands thereon;
   - a traversing means adapted to move the strands along the length of said collet, said traversing means having an axis of movement; and
   - guide means located adjacent said traversing means, said guide means having a plurality of spaced apart strand accommodating notches wherein at least two of the notches are contained in a reference plane that is obliquely oriented with respect to the axis of movement of said traversing means or axis of rotation of said collet to facilitate the maintenance of the individuality of each of the strands being wound into said package.

2. The apparatus of claim 1 wherein said traversing means is rotatable and said axis of movement is an axis of rotation.

3. Apparatus for attenuating and collecting glass filaments comprising:
   - feeder means adapted to supply a plurality of streams of molten glass;
   - attenuator means adapted to attenuate said streams into filaments and collect said filaments as a convolutely wound package, said filaments being gathered into a plurality of strands; said attenuator means having a rotatable collet adapted to wind said strands thereon and a rotatable traversing means adapted to agitate the strands as the strands are being wound upon said collet;
   - coating means adapted to apply a liquid coating to the filaments;

a guide element adapted to orient said filaments as a plurality of arrays associated with said coating means; and guide means located intermediate said guide element and said traversing means, said guide means having a plurality of spaced apart strand accommodating notches wherein at least two of the notches are contained in a reference plane that is obliquely oriented with respect to the axis of rotation of said traversing means to facilitate the maintenance of the individuality of each of the strands being wound into said package.

4. The apparatus of claims 1, 2, or 3 wherein all of said notches are contained within one reference plane.

5. The apparatus of claims 2 or 3 wherein alternate notches are contained within a common planar section.

6. The apparatus of claim 5 wherein said common planar section is parallel to the axis of rotation of said traversing means.

7. The apparatus of claims 1, 2 or 3 wherein each pair of adjacent notches are contained within a reference plane obliquely oriented at a different angle from the other angles determined by the other reference planes determined by the other adjacent pairs of notches.

8. The apparatus of claims 1 or 3 wherein said notches are positioned along a curved line.

9. The apparatus of claims 1, 2, or 3 wherein succeeding adjacent notches are contained within reference planes obliquely oriented with respect to each other.

10. The apparatus of claims 2 or 3 wherein said reference plane forms an angle with respect to the axis of rotation of the traversing device or the axis of rotation of said collet within the range from about 5° to about 65°.

11. The apparatus of claim 9 wherein the said angle is within the range from about 10° to about 55°.

12. The apparatus of claims 1 or 3 wherein said notches are located along a line having a non-straight shape.

13. The method of collecting a plurality of bundles of filaments into a single package comprising:

rotating a collector means to wind said bundles around said collector means;

providing a traversing means to direct said bundles along the axis of rotation of the collector means;

providing a guide means to direct the bundles into contact with the traversing means along spaced apart paths wherein at least two of said paths between the guide means and the traversing means substantially define a plane obliquely oriented with respect to the axis of rotation of the collector means.

14. The method of claim 13 wherein all of said bundles are contained within one plane.

15. The method of claim 13 wherein said bundles form a portion of at least one cone-shaped region.

16. The method of claim 15 wherein said cone-shape is arcuate.

17. The method of claim 13 wherein said plane is oriented with respect to the axis of rotation of the collector means at an angle within the range from about 5° to about 65°.

* * * * *